US009068288B2

(12) United States Patent
Kucukcoskun et al.

(10) Patent No.: US 9,068,288 B2
(45) Date of Patent: Jun. 30, 2015

(54) HOUSEHOLD APPLIANCE WHEREIN THE AMOUNT OF ENERGY CONSUMPTION IN THE STAND-BY MODE IS REDUCED

(75) Inventors: Bulent Kucukcoskun, Istanbul (TR); Mustafa Tezel, Istanbul (TR)

(73) Assignee: Arcelik Anonim Sirketi, Istanbul (TR)

( * ) Notice: Subject to any disclaimer, the term of this patent is extended or adjusted under 35 U.S.C. 154(b) by 670 days.

(21) Appl. No.: 13/130,565

(22) PCT Filed: Nov. 12, 2009

(86) PCT No.: PCT/EP2009/065061
§ 371 (c)(1), (2), (4) Date: May 20, 2011

(87) PCT Pub. No.: WO2010/057829
PCT Pub. Date: May 27, 2010

(65) Prior Publication Data

US 2011/0226294 A1 Sep. 22, 2011

(30) Foreign Application Priority Data

Nov. 21, 2008 (TR) ..... a 2008/08912

(51) Int. Cl.
*D06F 39/00* (2006.01)

(52) U.S. Cl.
CPC ..... *D06F 39/005* (2013.01)

(58) Field of Classification Search
None
See application file for complete search history.

(56) References Cited

U.S. PATENT DOCUMENTS

2003/0025395 A1 2/2003 Peterson

FOREIGN PATENT DOCUMENTS

| | | | |
|---|---|---|---|
| DE | 29504662 | U1 | 6/1995 |
| JP | 10262335 | A | 9/1998 |
| JP | 2005312174 | A | 11/2005 |

*Primary Examiner* — Jason Ko
(74) *Attorney, Agent, or Firm* — Venjuris, P.C.

(57) ABSTRACT

The present invention relates to a household appliance (1) comprising a control unit (2) which provides the amount of energy consumption in the stand-by mode to be reduced.

7 Claims, 1 Drawing Sheet

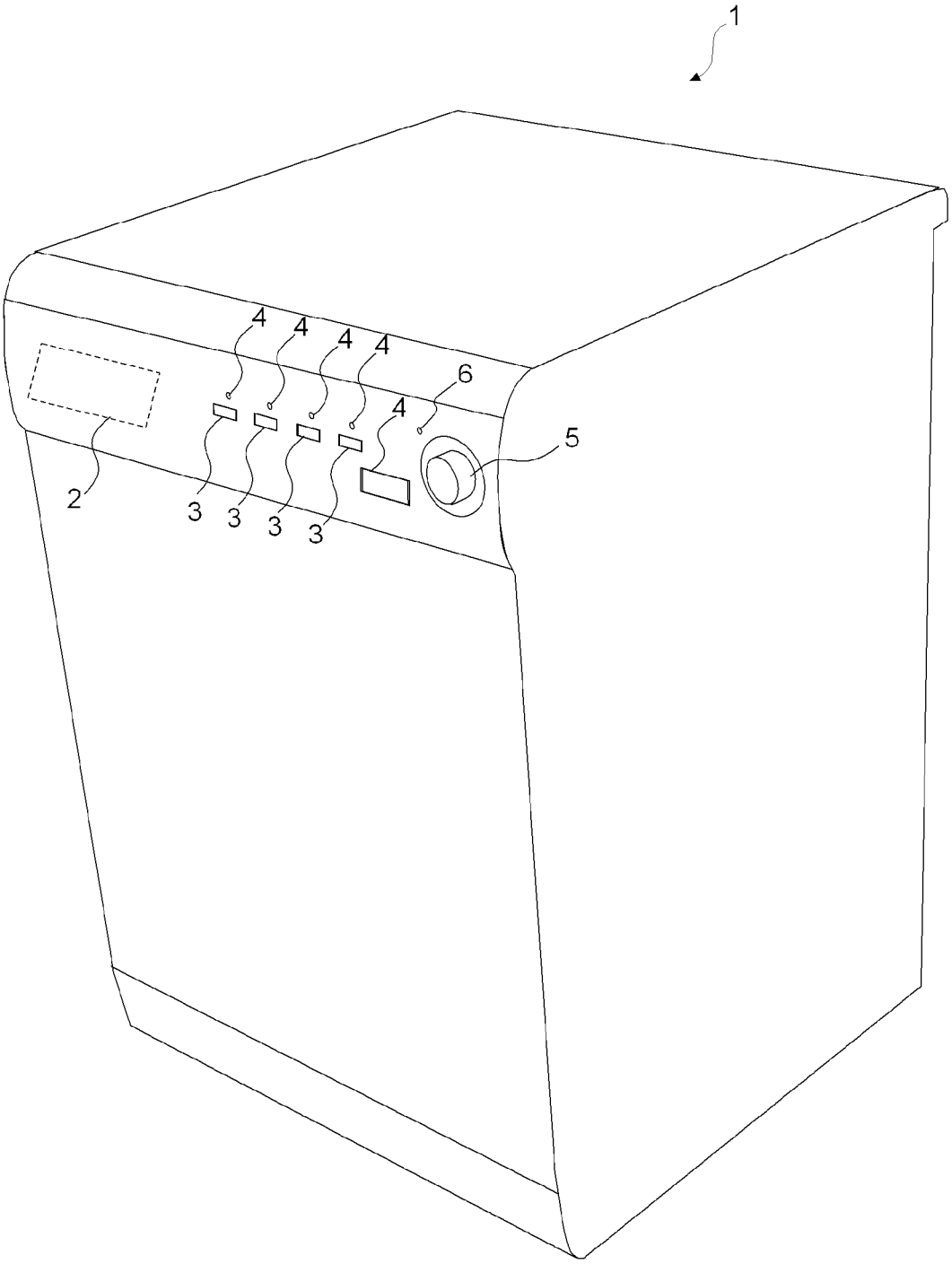
1
4
4
4
4
6
4
5
2
3
3
3
3

HOUSEHOLD APPLIANCE WHEREIN THE AMOUNT OF ENERGY CONSUMPTION IN THE STAND-BY MODE IS REDUCED

The present invention relates to a household appliance having a washing and/or drying function wherein the amount of energy consumed in the stand-by mode is reduced.

In electronically controlled household appliances having washing and/or drying functions, for example in washing machines, dishwashers and laundry dryers, an on-off switch is situated which provides the mains electricity to reach the household appliance. When the household appliance is energized by actuating the on-off switch, the displays located on the household appliance are illuminated, the LEDs belonging to the buttons such as the program selection buttons or the on-off switch are activated and light up, and thus, the user is provided to be warned about the position of the buttons. This mode wherein the household appliance is ready to receive a command for performing any function is called the stand-by mode. Furthermore, the household appliance changes from the operating mode to the stand-by mode right after the function desired by the user is completed and the household appliance remains in the stand-by mode as long as the on-off switch is not actuated to be changed to the passive position. In the stand-by mode, which could be understood by the user as the idle position of the household appliance wherein none of the programs are performed, reduction in the amount of energy consumed considered in terms of energy saving.

In the state of the art Japanese Patent Document No JP10262335, a current control device is described that is designed for reducing power consumption on standby as much as possible in household appliances.

In the state of the art Japanese Patent Application No JP2005312174, a power supply control circuit is described which is realized with the intention of reducing the energy consumption in the stand-by mode.

The aim of the present invention is the realization of a household appliance wherein the amount of energy consumption in the stand-by mode is reduced.

The household appliance realized in order to attain the aim of the present invention is explicated in the claims.

The household appliance of the present invention comprises an on-off switch which provides the delivery of the mains electricity to the household appliance, selection means which provide the selection of programs or entering of the program parameters, an on-off indicator which is activated as the on-off switch is actuated and indicators which warn the user about the position of the selection means. The household appliance, furthermore, comprises a control unit which, in the stand-by mode resumed as a result of actuating the on-off switch, provides the indicators to change to the passive position at the end of a waiting period predetermined by the manufacturer, and the on-off indicator to flash periodically, with alerting time intervals predetermined by the manufacturer. While energy saving is provided by changing the indicators to the passive position at the end of the waiting period, on the other hand the user is warned about the household appliance being in the stand-by mode as the on-off indicator is operated at certain intervals.

In an embodiment of the present invention, the indicator is a LED and lights up when in the active position.

In another embodiment of the present invention, the indicator is a display and is illuminated when in the active position.

The household appliance of the present invention can be a washing machine, a dishwasher, or a dryer.

The household appliance realized in order to attain the aim of the present invention is illustrated in the attached figures, where:

FIG. 1—is the perspective view of a household appliance.

The elements illustrated in the figures are numbered as follows:

1. Household appliance
2. Control unit
3. Selection means
4. Indicator
5. On-off switch
6. On-off indicator The household appliance (1) has an operating mode, a stand-by mode and an off mode, comprising a control unit (2) that controls the operation of the household appliance (1) in the selected mode, one or more selection means (3) which can be situated in two different positions, the active and the passive positions, and which, by being actuated, provides commands to be delivered to the control unit (2) in order to select a program and to enter the program parameters, one or more indicators (4) which warn the user about the position of the selection means (3), an on-off switch (5) which transmits the electricity received from the mains, and an on-off indicator (6) that changes to the active position when the on-off switch (5) is actuated.

The following symbols are used for explicating the household appliance (1) of the present invention:

$t_1$: The waiting period during which the indicators (4) and the on-off indicator (6) remain in the active position and thereafter the indicators (4) are closed while the household appliance (1) is in the stand-by mode, as long as none of the selection means (3) are actuated.

$t_2$: The time passing between the successive flashings of the on-off indicator (6) at the end of the waiting period ($t_1$).

In the household appliance (1) of the present invention, at the end of the waiting period ($t_1$) predetermined by the manufacturer and while the household appliance (1) is in the stand-by mode, the control unit (2) provides the indicators (4) to change to the passive position and the on-off indicator (6) to operate periodically such that it will flash at alerting time ($t_2$) intervals predetermined by the manufacturer.

In the household appliance (1) changed to the stand-by mode by actuating the on-off switch (5), the indicators (4), which warn the user about the position of the on-off indicator (6) and the selection means (3) that provide the program selection or entering of the program parameters, light up by being activated. The on-off indicator (6) and the indicators (4) continuously in the lighted up position during the waiting period ($t_1$) as long as the user does not change the household appliance (1) to the operating mode by selecting any one of the programs by means of the selection means (3). In the case none of the selection means (3) are actuated during the waiting period ($t_1$), the control unit (2) does not receive any signal for performing any one of the programs. The control unit (2) provides the indicators (4) to change to the passive position at the end of the waiting period ($t_1$), and the on-off indicator (6) to operate in the flashing mode at alerting time ($t_2$) intervals. Thus, the user is warned that the household appliance (1) is in the stand-by mode such that it can command the control unit (2). Furthermore, by changing the indicators (4) to the passive position until the user gives a command to the control unit (2), the amount of energy consumption in the stand-by mode is reduced and energy saving is provided.

In an embodiment of the present invention, the selection means (3) is a push-button which is actuated by pressing thereon.

In an embodiment of the present invention, the indicator (4) is a LED. In this embodiment, the indicator (4) lights up when in the active position.

In another embodiment of the present invention, the indicator (4) is a display. In this embodiment, the indicator (4) is illuminated when in the active position.

The household appliance (1) of the present invention can be a washing machine, a dishwasher, or a dryer.

In the household appliance (1) of the present invention, while the indicators (4) are prevented from continuously remaining in the active position and thus, energy saving is provided in the stand-by mode, the on-off indicator (6) remains operating such that it will warn the user that the household appliance (1) is operating in the stand-by mode.

It is to be understood that the present invention is not limited to the embodiments disclosed above and can be used in a household appliance (1) having a washing and/or drying function as well as in an oven. A person skilled in the art can easily introduce different embodiments of the present invention. These should be considered within the scope of the protection postulated by the claims of the present invention.

The invention claimed is:

1. A household appliance (1) having a washing and/or drying function with an operating mode, a stand-by mode and an off mode, comprising a control unit (2) which controls the operation of the household appliance (1) in the selected mode, one or more selection means (3) which can be situated in two different positions, the active and the passive positions, and which, by being actuated, provides commands to be delivered to the control unit (2) in order to select a program and to enter the program parameters, one or more indicators (4) which warn the user about the position of the selection means (3), an on-off switch (5) which transmits the electricity received from the mains, and an on-off indicator (6) which changes to the active position when the on-off switch (5) is actuated and wherein the control unit (2) which, while in the stand-by mode, cause the indicators (4) to indicate that the one or more selection means have changed to the passive position at the end of the first waiting period ($t_i$) predetermined by the manufacturer, and the on-off indicator (6) to operate periodically such that it will flash at alerting time intervals ($t_2$) predetermined by the manufacturer and wherein the household appliance (1) is selected from the group consisting of a washing machine, a dishwasher and a dryer.

2. The household appliance (1) as in claim 1, wherein the selection means (3) which is a push-button.

3. The household appliance (1) as in claims 1 and 2, wherein the indicator (4) is a LED.

4. The household appliance (1) as in claims 1 and 2, wherein the indicator (4) is a display.

5. A household appliance (1) as in claim 2,wherein the household appliance is a washing machine.

6. A household appliance (1) as in claim 2,wherein the household appliance is a dishwasher.

7. A household appliance (1) as in claim 2,wherein the household appliance is a dryer.

* * * * *